United States Patent [19]

Valvis

[11] Patent Number: 5,040,347

[45] Date of Patent: Aug. 20, 1991

[54] STANDARDIZED PROFILES FOR WINDOW OR DOOR FRAME PARTITIONS AND METHOD OF ASSEMBLY

[76] Inventor: Constantinos Valvis, 42 Metsovou St., 175 63, Paleo Faliron, Greece

[21] Appl. No.: 461,266

[22] Filed: Jan. 5, 1990

[51] Int. Cl.[5] ..... E04B 2/88; E06B 1/18

[52] U.S. Cl. ..... 52/397; 52/235; 52/456; 29/445

[58] Field of Search ..... 52/397, 398, 235, 456, 52/741; 29/445

[56] References Cited

U.S. PATENT DOCUMENTS 2,914,145 11/1959 Benson ..... 52/235
3,221,453 12/1965 Lietaert ..... 52/235
3,734,550 5/1973 Vance ..... 52/235

*Primary Examiner*—John E. Murtagh

[57] ABSTRACT

The present invention relates to a new method for making partitions in fixed or openable by means of drawing aside, pushing or pulling, window or door frames, bearing glass panels. The method is implemented by means of a series of standardized profiles made form aluminium, plastic or other desired material. As illustrated in FIG. 14, which is proposed for publication, the method is in particular implemented by means of a first profile designed so as to receive a glass panel and a second profile fitted onto the first to form horizontal and vertical partitions, as well as a third and fourth standardized profiles used in the circumference of the window or door frame.

3 Claims, 5 Drawing Sheets

STANDARDIZED PROFILES FOR WINDOW OR DOOR FRAME PARTITIONS AND METHOD OF ASSEMBLY

THE FIELD OF THE ART

The present invention relates to the field of the art of making partitions in all types of window or door frames, i.e. fixed or openable by means of drawing aside, pushing or pulling. The invention also describes a series of standardized profiles of aluminium or other suitable material, by means of which the proposed method is implemented.

THE BACKGROUND ART

Making partitions, uniform or non-miniform, in window or door frames of all types, either fixed or openable by means of drawing, pulling or pushing, is a broadly used technique, mainly because of aesthetic preferences, and is well known in the prior art. The partition elements are used to divide transparent glass or other transparent and non-transparent panels. Such constructions are up today made using normally wooden partition elements and here it is well known that such constructions entail a high cost and often present aesthetic deficiencies, whereas it is also known that wood shows a low strength in all kinds of stresses and in particular in the wear due to weather conditions, thereby necessitating frequent and costly maintenance.

Thus, a first object of the invention is to effectively overcome the above disadvantages of the prior art and to provide a new method of making partitions into window or door frames of all types using a series of standardized profiles, which because of the material they are made from (e.g. aluminium or plastic), offer the advantages of a high strength without any substantial maintenance, as well as the low manufacturing and assemblying cost because of the standardization in the entire process. Furthermore, it should be noted that the method proposed in the present invention eliminates the need of using the traditional battens used to support the glass panels.

The above object of the invention is accomplished by means of a series of profiles and in accordance to a preferred embodiment of the invention a pair of mutually assembled profiles, which may be offered in the desired dimensions and form, their spacing varying and being adjusted by means of a plastic packing, which slides within suitable recession channels of the profiles. Assemblying of these profiles ensures an optimum aesthetic appearance, a variety of combinations of forms, colours and generally design, which might either be the same on either side or different on each side of the frame.

A further object of the invention is to provide the maximum possible safety by means of the abovementioned, standardized, mutually assembled partition profiles, not only because of the partitions in the glass panels and the partition profiles which after having been assembled is impossible to disconnect and break the door open, but also because of the preferable introduction within the interior gap formed between the assembled profiles of steel plates to further increase safety.

A further object of the invention is to secure the maximum possible water and air-tightness and therefore to drastically reduce and even eliminate the heat losses due to air leakages at the circumferential joints of the glass panels. Such heat losses are by far greater in conventional window and door frames bearing partitions, because of the increased perimeter wherefrom such leakages may occur. This object of the invention is accomplished by means of a flexible plastic packing, which is introduced on either side of the glass panel within suitable recession channels in the abovementioned mutually assembled profiles.

These and other objects, characteristics and advantages of the present invention will be made apparent in the detailed description below.

BRIEF DESCRIPTION OF THE DRAWINGS

The present invention will be made clearly understood by those skilled in the art by reference to the accompanying drawings, which present in an illustrative and not confining manner the profiles used in the implementation of the method of making partition profiles in window or door frames of all types, proposed in the present invention.

Figure 1:
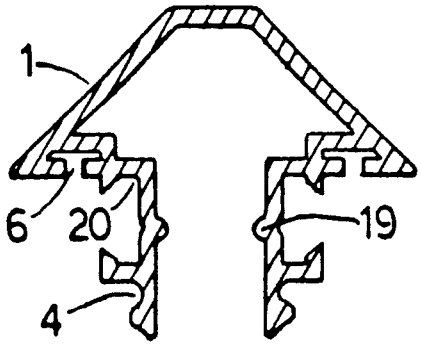
FIG. 1 shows a cross sectional view of a first basic profile which is depicted in a trapezoidal form, suitably formed to receive a glass panel in accordance to the method of making partitions in window or door frames of the present invention.
Figure 2:
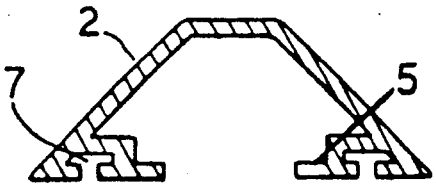
FIG. 2 shows a cross sectional view of a second, by way of illustration trapezoidal section profile, which is assembled onto the first basic profile of FIG. 1.
Figure 4:
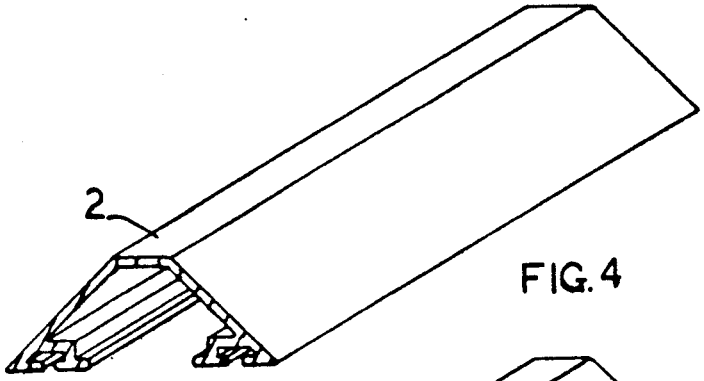
FIG. 4 shows a perspective view of a portion of the illustratively trapezoidal second basic profile of FIG. 2.
Figure 3:
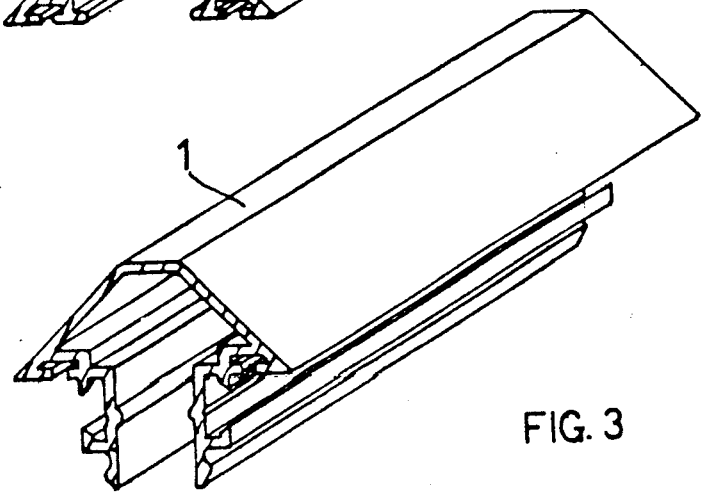
FIG. 3 shows a perspective view of a portion of the illustratively trapezoidal, first basic profile of FIG. 1.
Figure 5:
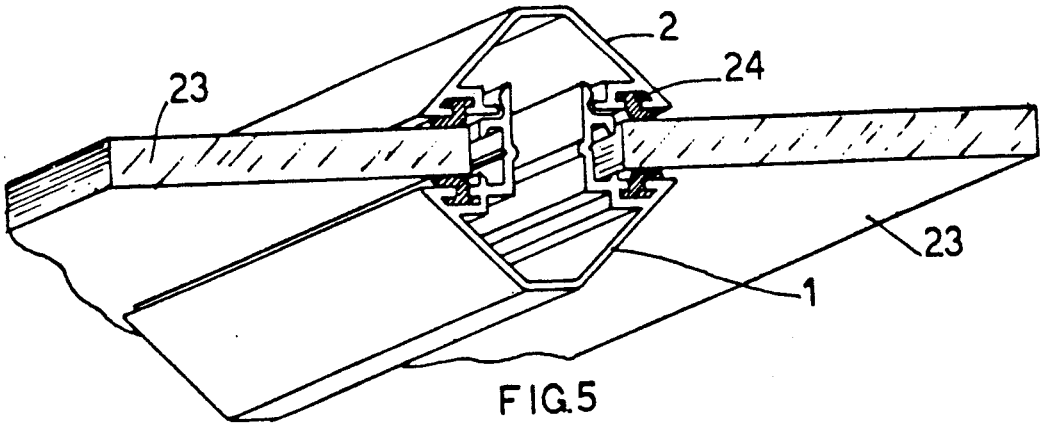
FIG. 5 shows in a perspective detail view the assembly process of the illustratively trapezoidal first basic profile suitably formed to receive a single glass panel and of the second profile fitted into it.

The individual profiles and other accessories used in the implementation of the method of the present invention are briefly listed and explained below in an order corresponding to their numbering in the accompanying drawings.

1. Basic standardized profile for the reception of a glass panel and the creation of horizontal/vertical partitions.

2. Standardized profile assembled onto profile 1.

3. Circumferential profile for the reception of a glass panel.

4. Formation of the upper end of the basic profile for the reception of glass panel 1, designed so as to receive a correspondingly formed end of profile 2.

5. Formation in the interior of the upper end of profile 2, designed so as to fit into the corresponding formation 4 of profile 1.

6,7,8. Channels in the profiles 1, 2 and 3 respectively, designed so as to receive a flexible rubber packing.

9,10. Formations on either side of the circumferential profile 3, designed so as to allow fitting onto a conventional, circumferential, window or door frame profile.

11, 12. Formations on either side of a conventional circumferential window or door frame profile, designed so as to fit into the corresponding formations 9 and 10 of the circumferential profile 3.

13. Conventional profile on the circumference of the window or door frame.

14. Channel within profile 3, wherein the glass panel is introduced and the connection accessories can slide.

15. Foot member of the connection accessory.

16. Edge of the connection accessory inclined at 45 to enable sliding along a corresponding inclined profile surface.

17. Hole through the connection accessory.

18. Vertical guide slots on the connection accessory within which slides a corresponding formation of profile 1.

19. Formation of profile 1, designed so as to fit onto the connection accesory.

20. Channel within profile 1 allowing for the reception of a glass panel.

21. Reinforcing steel plate.

22. Connection accessory.

23. Glass panel.

24. Rubber packing.

25. Channel in the circumferential covering profile.

26. Formation of the basic circumferential profile 3, designed so as to fit into channel 25.

27. Formation in the circumferential covering profile.

28. Slot in the circumferential profile 3, allowing fitting into the corresponding formation 27.

29. Channel in the circumferential covering profile, wherein the rubber packing is introduced.

30. Circumferential covering profile.

DETAILED DESCRIPTION OF THE INVENTION

Referring now to the accompanying drawings, herein will be described certain illustrative, preferred embodiments of the invention.

The invention refers to a method of making partitions in window or door frames of all types, either fixed or openable by means of drawing aside, pushing or pulling, without however being confined in this field of application. The same method and series of standardized profiles may be used in a plurality of various other structures, either independently or in conjunction with other traditional elements, such as by way of example interior decoration, partition panels, furniture, store shelves, false roofs, etc.

The method comprises manufacturing of continuous lengths of a series of standardized profiles, which are thereinafter cut to the specifically required, suitable length for the usage they are planned for. The external surfaces of the profiles are made or cut at an illustrative angle of 45, to allow a precise standard fitting procedure.

The material of construction of the profiles, as well as of the connection accessories may be aluminium or other metal or plastic or other desired, suitable material, the criteria being the low cost in combination with the aesthetic perfection and high strength.

Figure 14:
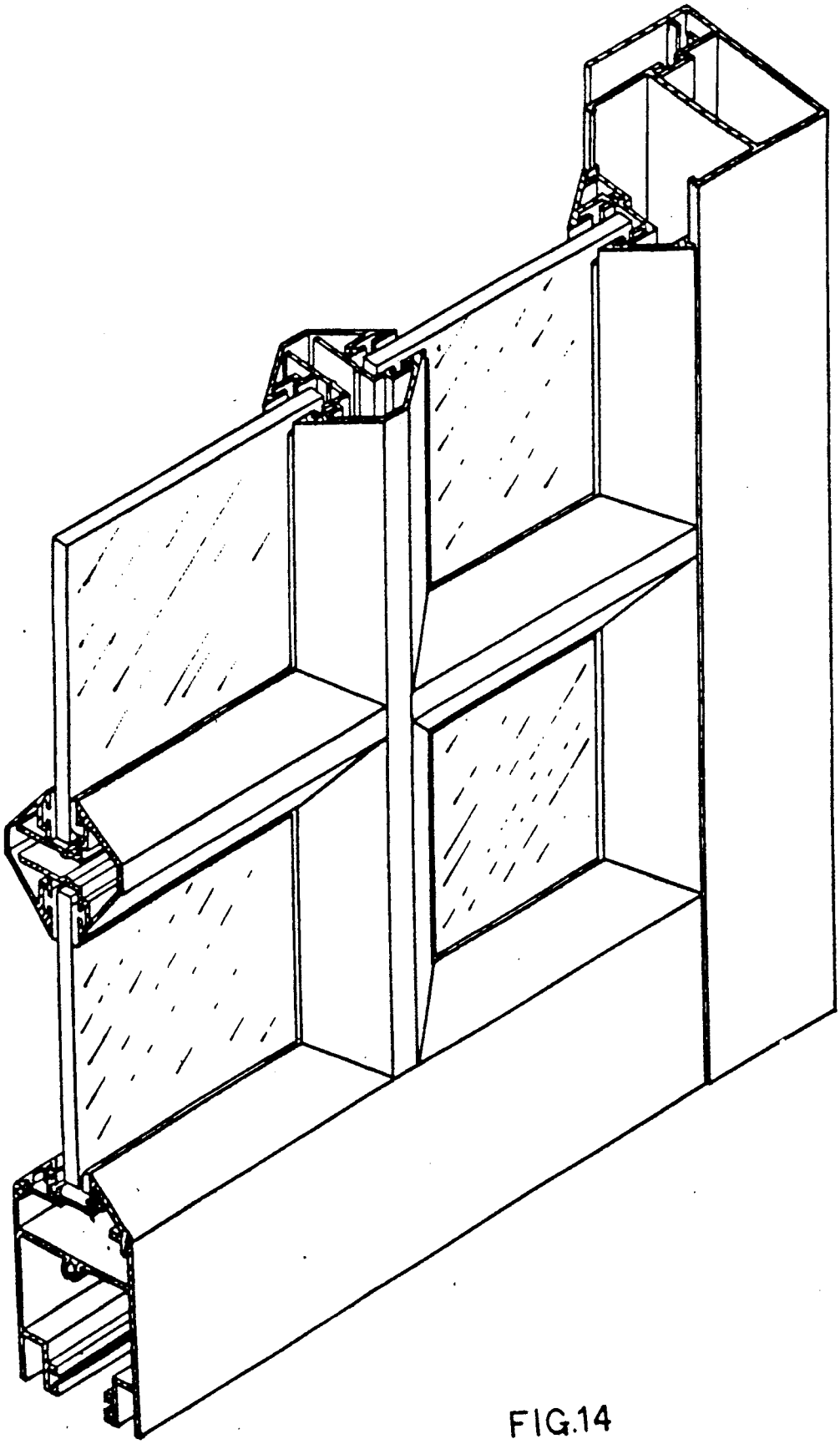
FIG. 14 shows a partial perspective view of a window or door frame with the partitions created with the series of standardized profiles of the invention.

A pair of profiles 1 and 2 are employed in the process of making horizontal and vertical partitions, by way of example in the frame depicted in FIG. 14. Profile 1 is the basic profile designed so as to receive a glass panel 23 and profile 2 is a profile designed so as to fit onto profile 1 and appear at the other surface of the glass panels. Such assembly of profiles 1 and 2 is made by means of mutual fitting of the longitudinal formations 5 provided on either side of profile 2 into the correspondingly spaced formations 4 of profile 1.

Figure 6:
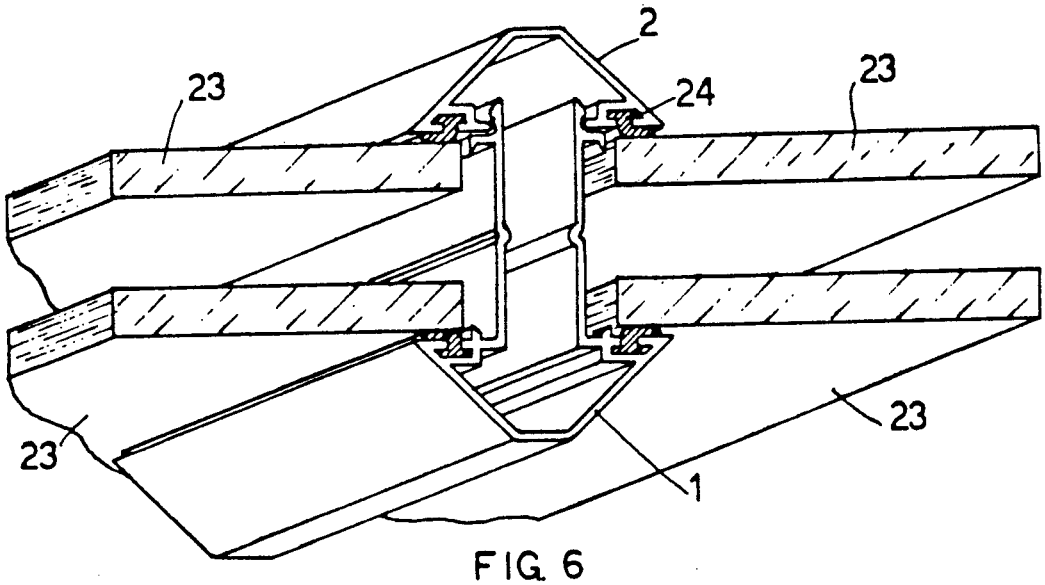
FIG. 6 shows in a perspective detail view the assembly process of the illustratively trapezoidal first and second profiles, where the first basic profile is suitably formed to receive a double glass panel.

The rubber packing 24 in introduced within the appropriate channels 6 and 5 of the profiles 1 and 2 respectively, prior to the assembly of the latter. The glass panel is introduced within channel 20 of the basic profile 1 in between the two rubber packings. In this case the legs of profile 1 have such a length that a single glass panel is introduced within channel 20, whereas as illustrated in FIG. 6 the legs of profile 1 have a greater length and thereby channel 20 a correspondingly greater width so as to allow introduction of a double glass panel.

Figure 7:
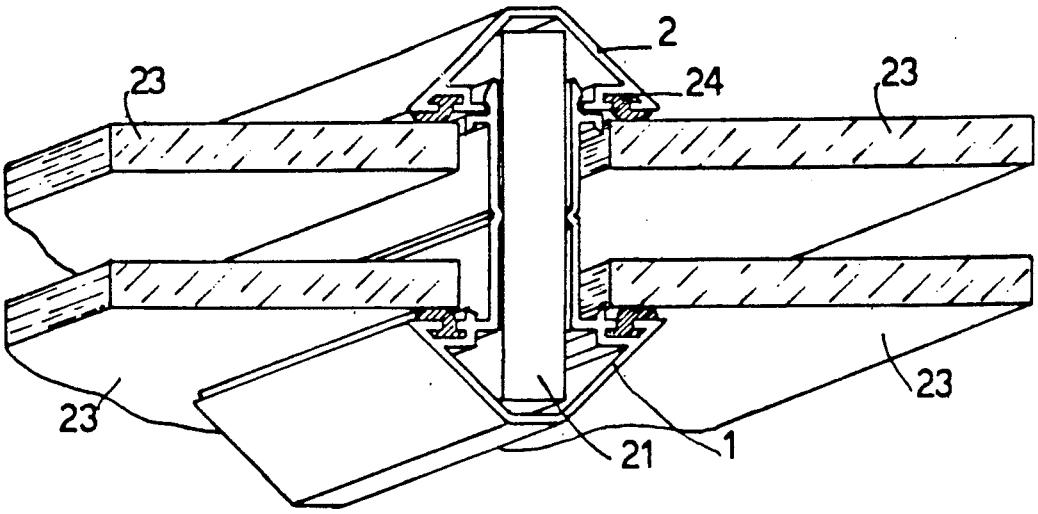
FIG. 7 shows in a perspective detail view the assembly process of the illustratively trapezoidal first and second profiles, where a steel plate to reinforce the construction has been introduced in the gap in between them.
Figure 8:
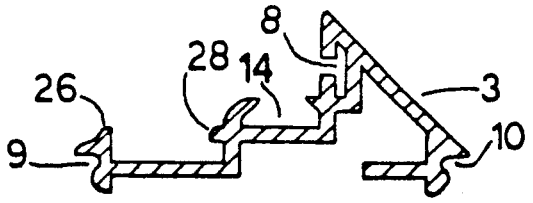
FIG. 8 shows a cross sectional view of a circumferential profile, suitable for mounting at the perimeter of the window or door frame.

In accordance to a preferred embodiment of the invention a reinforcing steel plate 21 is introduced in the gap formed between the assembled profiles 1 and 2, so as to increase safety of the construction, as illustrated in FIG. 7.

Figure 9:
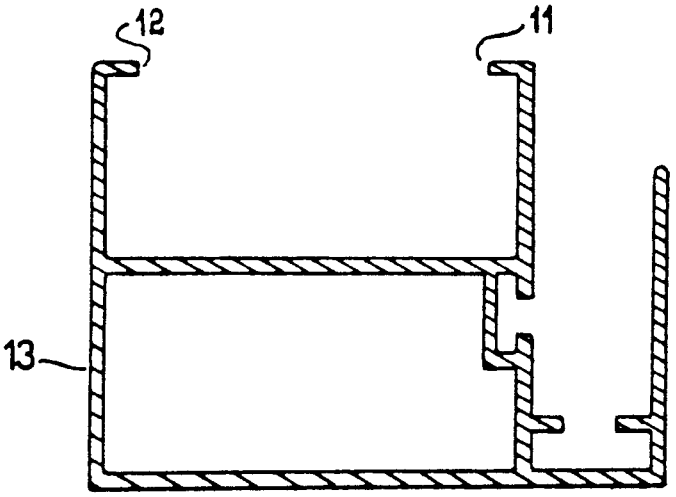
FIG. 9 shows a cross sectional view of an illustrative, broadly used, conventional circumferential window or door frame profile, onto which the profile of FIG. 8 is mounted in order to implement the method of the invention.
Figure 10:
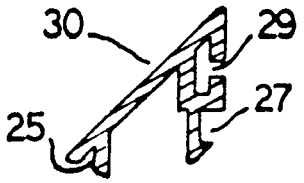
FIG. 10 shows a cross sectional view of an illustrative profile assembled onto the profile shown in FIG. 8 onto the free surface of the glass panel.
Figure 11:
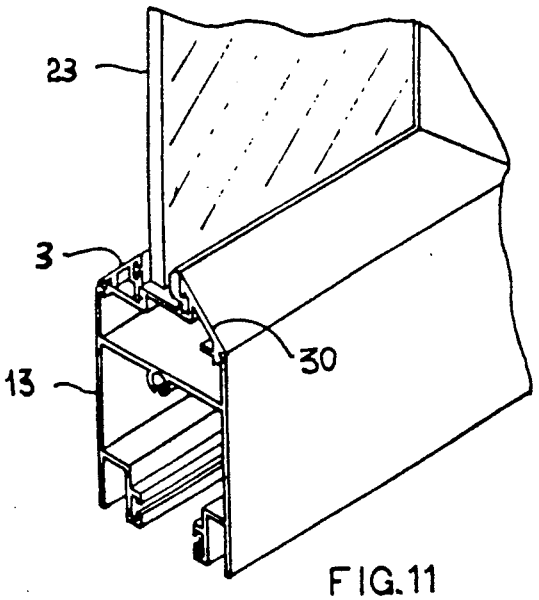
FIG. 11 shows in a perspective detail view the assembly process of the profiles depicted in FIGS. 8 and 10 onto the conventional circumferential profile depicted in FIG. 9.

The conventional and broadly available profile 13 of FIG. 9 is mounted at the circumference of the window or door frame and the specially formed circumferential profile 3 bearing formations 9 and 10 on either side is fitted onto the corresponding formations 11 and 12 respectively, which are arranged at the necessary width of profile 13.

The circumferential profile 3 is provided with a channel 14, within which is introduced and sits the glass panel 23, and an adjacent channel 8 within which the rubber packing 24 is introduced. Following introduction of the glass panel 23 into the circumferential profile 3, the circumferential covering profile 30 is fitted on the other side of the glass panel. The circumferential covering profile 30 is provided with formations-channels 25 and 27, by means of which it is fitted upon the correspondingly spaced formations 26 and 28 of the circumferential profile 3. Profile 30 is also provided with a channel 29, wherein the rubber packing 24 is introduced.

Alternatively, in accordance to another illustrative, preferred embodiment of the invention, the circumferential profile may be produced as a single unit together with the conventionally used profile 13, thereby eliminating the need for the fitting formations 11,12 and 9,10 respectively.

Figure 12:
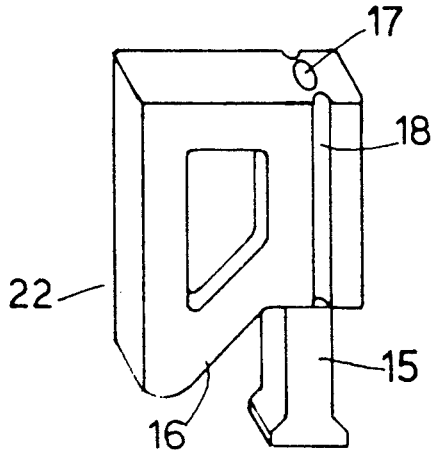
FIG. 12 shows a perspective view of an illustrative form of a connection accessory used in the assembly process of the profiles used to create horizontal and vertical partitions.
Figure 13:
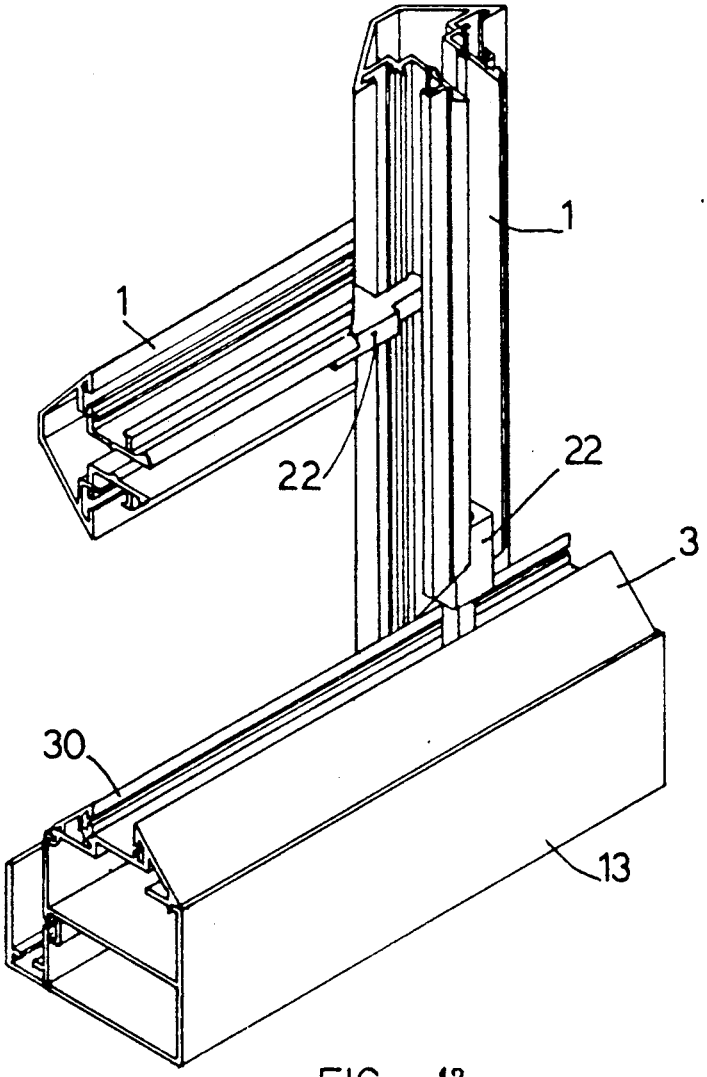
FIG. 13 shows a perspective view, illustrating the way in which the connection accessory is used in conjunction with the circumferential profile and with the basic profile for the reception of the glass panel.

A connection accessory 22 illustrated in FIG. 12 is used in the process of connection of the horizontal to the vertical partitions. The main body of the connection accessory includes an inclined surface 16, with a shape and angular inclination such as to tangentially fit onto corresponding inclined surfaces of the profiles, which have to be connected. Each connection accessory is also provided with a hole 17 which runs from the top to the foot bottom 15 of the same. A bolt passing through hole 17 is used to fix the connection accessory onto a desired location. The foot-bottom 15 of the connection accessory 22 is introduced, as illustrated in FIG. 14, within the longitudinal slot-channel 28 of the circumferential profile 3 or within the slot-channel 20 of profile 1. Furthermore, each connection accessory 22 is provided with longitudinal vertical guide slots 18 on either side of hole 17, where corresponding formations 19 of profile 1 are introduced and slide within these guide slots 18. The eventual position of the connection accessory is determined by the desired length of horizontal and vertical partitions.

The external appearance as depicted in FIG. 14 both of the basic profile 1 designed so as to receive the glass panels and of the profile 2 which is assembled together with profile 1, is trapezoidal. Nevertheless this external appearance may vary and by way of example by triangular, rectangular, any rectilinear, circular, elliptical or of any other desired shape.

It must hereby be noted that the detailed description of the present invention was made by reference to merely illustrative and not confining examples. Thus any change or amendment relating to different dimensions, forms, materials and accessories used in the manufacturing and assembly process, as long as it does not comprise a new inventive step must be considered part of the scope and the aims of the present invention, the basic characteristics of which are summarized in the following claims:

I claim:

1. A partitioning assembly for glass panels of doors, windows and the like, comprising a first basic standardized profile (1) designed so as to receive and support a glass panel (23) within a longitudinally disposed receiving channel (20), said first basic standardized profile (1) having longitudinally disposed channels (6) for the introduction of water and air-tightening rubber packing (24) on either of its glass contacting ends, said first basic standardized profile (1) having ends with longitudinally disposed formations (4) extending beyond its glass receiving surface, said first basic standardized profile (2) designed so as to fit onto said first standardized profile (1), its outer surface appearing at the reverse side of said glass panel (23), a second standardized profile (2) having longitudinally disposed channels (7) for the introduction of water and air-tightening rubber packing (24) on either of its glass contacting ends, said second standardized profile (2) having ends with longitudinally disposed formations (5) fitting snugly within correspondingly shaped said formations (4) of said first basic standardized profile (1), said second standardized profile (2) having an outer surface of a trapezoidal form with side walls inclined at 45° on either side of a middle portion parallel to said glass panel (23), disposed at the reverse side of said glass panels (23) than correspondingly shaped outer surface of said first basic standardized profile (1), a third standardized circumferential profile (3) disposed at the perimeter of the window, door and the like frame and having a channel (14) within which the glass panel (23) sits, said third standardized circumferential profile (3) having longitudinally disposed channels (8) for the introduction of water and air-tightening rubber packing (24) on either of its glass contacting ends, said third standardized circumferential profile (3) having ends with longitudinally disposed formations (26) and (28), said third standardized circumferential profile (3) having at one side thereof a plane surface inclined at 45°, a fourth standardized circumferential covering profile (30) designed so as to fit onto said third standardized circumferential profile (3), having an outer plane surface inclined at 45° appearing at the reverse side of said glass panels (23) to said plane surface of said third circumferential profile (3), said fourth standardized circumferential covering profile (3) having ends with longitudinally disposed formations (25) and (27) fitting snugly within correspondingly shaped said formations (26) and (28) of said third standardized circumferential profile (3), and connection means (22) used in the process of slidably connecting a horizontally disposed said first basic standardized profile (1) to another adjacent vertically disposed said first basic standardized profile (1) and in the process of slidably connecting a horizontally or vertically disposed said first basic standardized profile (1) to a vertically or horizontally disposed said third circumferential profile (3), said connection means (22) having a main body with one lower end (16) inclined at 45° to tangentially fit onto correspondingly inclined surfaces of said first basic standardized profile (1) or said third circumferential profile (3) and one lower foot member end (15) slidably introduced within channel (20) of said first basic standardized profile (1) or channel (14) of said third circumferential profile (3), a hole (17) drilled from the lower to the upper end of said foot member (15) to firmly mount by means of a bolt said connection means (22) at a desired location along said profiles, said connection means (22) having longitudinally disposed guide slots (18) slidably introduced within correspondingly shaped guide formations (19) of said first basic standardized profile (1).

2. The partitioning assembly for glass panels of doors, windows and the like, including an elongated reinforcing steel plate (21) introduced into the free gap in between an assembled length of said first basic standardized profile (1) and said second standardized profile (2).

3. Method of making partitions into glass panels of doors, windows and the like comprising the steps of:

cutting to length the required pieces of said third circumferential profile (3) and mounting it along the perimeter of the fixed door or window frame, cutting to length a plurality of a first series of pieces of said first basic standardized profile (1) at an equal size corresponding to the width of the door or window frame, the edges of each said piece being cut at an angle of 45° to allow for a precise mutual fit onto the external surface of circumferentially mounted said circumferential profile (3), said first series of pieces being mounted horizontally and spaced at vertical distances corresponding to the vertical length of glass panels, cutting to length a plurality of a second series of pieces of said first basic standardized profile (1) at an equal size corresponding to the height of the door or window frame, the edges of each said piece being cut at an angle of 45° to allow for a precise mutual fit onto the external surface of horizontally mounted said first series of pieces, said second series of pieces being mounted vertically and spaced at horizontal distances corresponding to the horizontal length of glass panels, placing the previously cut to the desired vertical and horizontal lengths glass panels within said longitudinal disposed receiving channels (20) of the spaces formed by the assembly of said first series of horizontally mounted and said second series of vertically mounted profiles, cutting to length the required pieces of said fourth circumferential profile (30) and snugly fitting said pieces along the perimeter of the fixed door or window frame onto said previously mounted circumferential profile (3) at the reverse side of previously mounted glass panels, cutting to the length of the first series of pieces of said first basic standardized profile (1) a first series of pieces of said second standardized profile (2), the edges of each said piece being cut at an angle of 45° to allow for a precise mutual fit upon the previously mounted circumferential covering profile (30), said first series of pieces of said second standardized profile (2) being mounted horizontally with a snugly fit onto said first basic standardized profiles (1) at the reverse side of previously mounted glass panels, and cutting to the length of the second series of pieces of said first basic standardized profile (1) a second series of pieces of said second standardized profile (2), the edges of each said piece being cut at and angle of 45° to allow for a precise mutual fit upon the previously mounted circumferential covering profile (30) and intermediate vertically mounted first series of pieces of said first basic standardized profile (1), said second series of pieces of said second standardized profile (2) being mounted vertically with a snugly fit onto said second series of pieces of vertically mounted first basic standardized profiles (1) at the reverse side of previously mounted glass panels.

* * * * *